US006656000B2

(12) United States Patent
Abdo

(10) Patent No.: US 6,656,000 B2
(45) Date of Patent: Dec. 2, 2003

(54) SPEAKER TERMINAL BLOCK ASSEMBLY

(76) Inventor: Nasser Abo Abdo, 301 W. Country Hills Dr., La Habra, CA (US) 90631

( * ) Notice: Subject to any disclaimer, the term of this patent is extended or adjusted under 35 U.S.C. 154(b) by 0 days.

(21) Appl. No.: 10/127,820

(22) Filed: Apr. 23, 2002

(65) Prior Publication Data

US 2003/0199207 A1 Oct. 23, 2003

(51) Int. Cl.[7] ..... H01R 11/09
(52) U.S. Cl. ..... 439/797
(58) Field of Search ..... 439/709, 712, 439/715, 716, 717, 718, 797, 798

(56) References Cited

U.S. PATENT DOCUMENTS 4,040,711 A * 8/1977 Waddington et al. ..... 439/797
4,734,061 A * 3/1988 Randall et al. ..... 439/709
5,378,174 A * 1/1995 Brownlie et al. ..... 439/709
5,588,874 A * 12/1996 Pruehs et al. ..... 439/517
6,325,675 B1 * 12/2001 Harmeyer ..... 439/709

* cited by examiner

*Primary Examiner*—Hien Vu
(74) *Attorney, Agent, or Firm*—Irving Keschner

(57) ABSTRACT

A terminal block assembly that enables multiple speakers, or woofers, to be connected in a series or parallel. In a first embodiment, the terminal block assembly has four receiving ports, two ports being formed in a first metal holder and two ports being formed in a second metal holder. The output leads from a first speaker are coupled to the two of the receiving ports; the output leads from a second speaker are coupled to the other two receiving ports. The output leads are mounted securely in the receiving ports using fastening screws. The outputs from a power amplifier are coupled to the input terminals on the terminal block. In a second embodiment, the terminal block assembly comprises two receiving ports, both port being formed in a metal holder.

1 Claim, 2 Drawing Sheets

FIG. 4
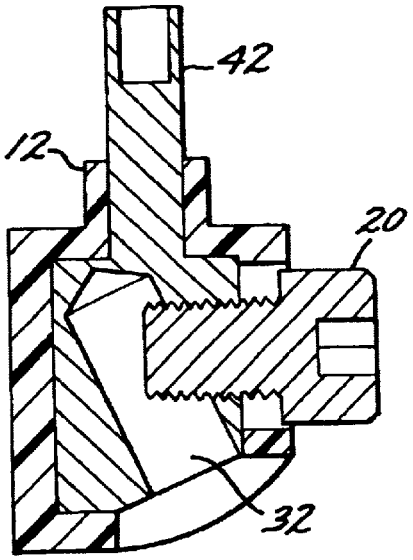
FIG. 5
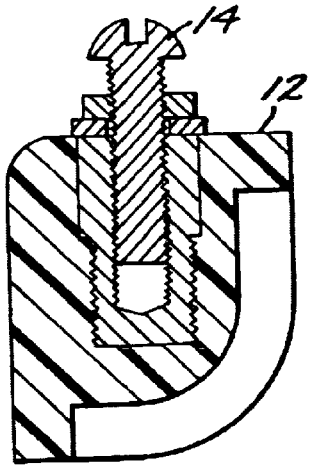
FIG. 6
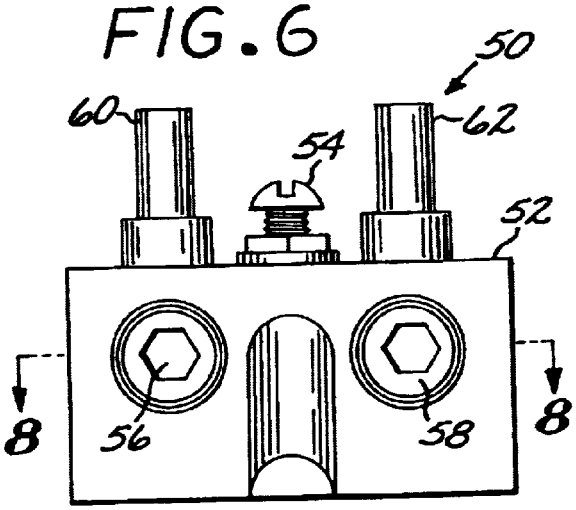
FIG. 7
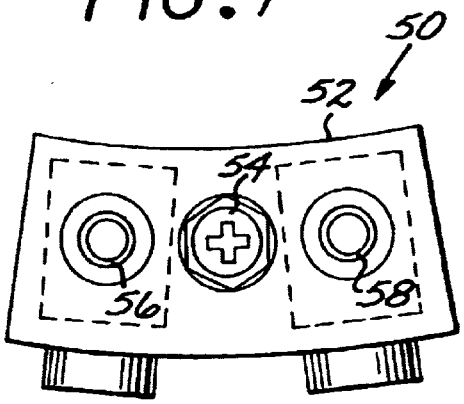
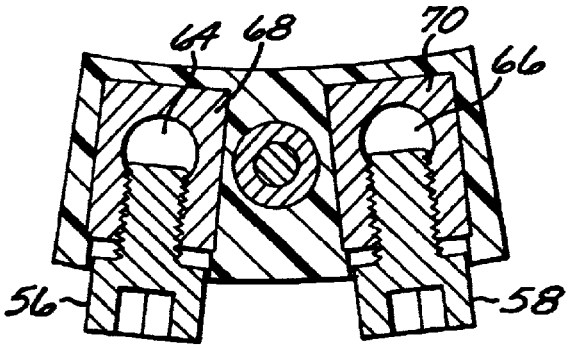
FIG. 8

SPEAKER TERMINAL BLOCK ASSEMBLY

BACKGROUND OF THE INVENTION

1. Field of the Invention

The present invention provides an improved electrical terminal block for speakers, particularly vehicle audio speakers.

2. Description of the Prior Art

As consumer interest in high power speakers have increased, manufacturers have accordingly enhanced the performance capabilities of their speaker product line. However, the increased cost of such enhanced speakers have caused customers to look at other options which will utilize existing speakers or woofers. In this regard, it has been suggested that a connection of multiple speakers, in parallel or series, will provide enhanced performance without the attendant increase in costs. However, a low cost terminal block assembly that would enable such connections is currently unavailable.

What is therefore desired is to provide a terminal block assembly which enables speakers, or woofers, to be connected in parallel or series.

SUMMARY OF THE PRESENT INVENTION

The present invention provides a terminal block assembly that enables multiple speakers, or woofers, to be connected in series or parallel.

In a first embodiment, the terminal block assembly has four receiving ports, two ports being formed in a first metal block, or holder, and two ports being formed in a second metal holder. The output leads from a first speaker are coupled to the two of the receiving ports; the output leads from a second speaker are coupled to the other two receiving ports. The output leads are mounted securely in the receiving ports using fastening screws. The output leads from a power amplifier are connected to input terminals formed on the terminal block In a second embodiment, the terminal block assembly comprises two receiving ports, each port being formed in a metal holder, the configuration otherwise being similar to that of the first embodiment.

DESCRIPTION OF THE DRAWINGS

For a better understanding of the present invention as well as other objects and further features thereof, reference is made to the following description which is to be read in conjunction with the accompanying drawing therein:

FIG. 4 is a cross-sectional view along line 4—4 of FIG. 3;

FIG. 5 is a cross-sectional view along line 5—5 of FIG. 3;

FIG. 6 is a front view of a two wire terminal block assembly;

FIG. 7 is a top view of the terminal block assembly shown in FIG. 6; and FIG. 8 is a cross-sectional view along line 8—8 of FIG. 6.

DESCRIPTION OF THE INVENTION

Figure 1:
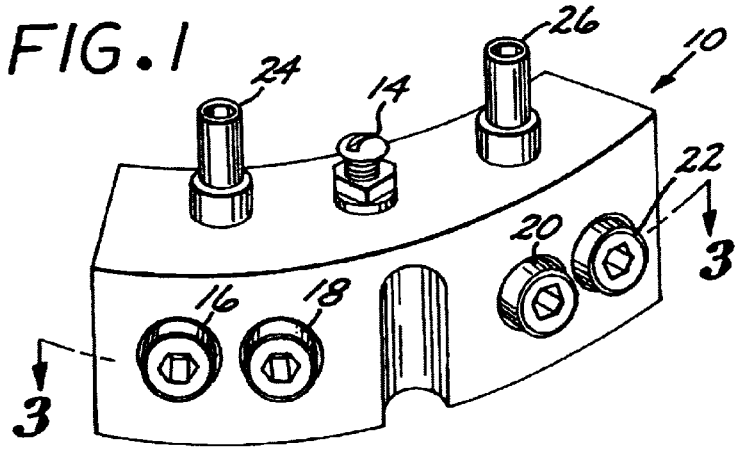
FIG. 1 is perspective view of the four wire terminal block assembly.

Referring now to FIG. 1, a perspective view of a four channel terminal block assembly 10 in accordance with the teachings of the present invention is illustrated. Assembly 10 is particularly adapted for use with audio equipment, such as vehicle speakers and comprises a plastic block portion 12, screw 14, wire retaining screws 16, 18, 20 and 22 and terminals 24 and 26, terminals 24 and 26 receiving the electrical acoustic signal through the speaker amplifier (not shown). Screw 14 mounts the terminal block assembly 10 to the speaker, or woofer, chassis.

Figure 2:
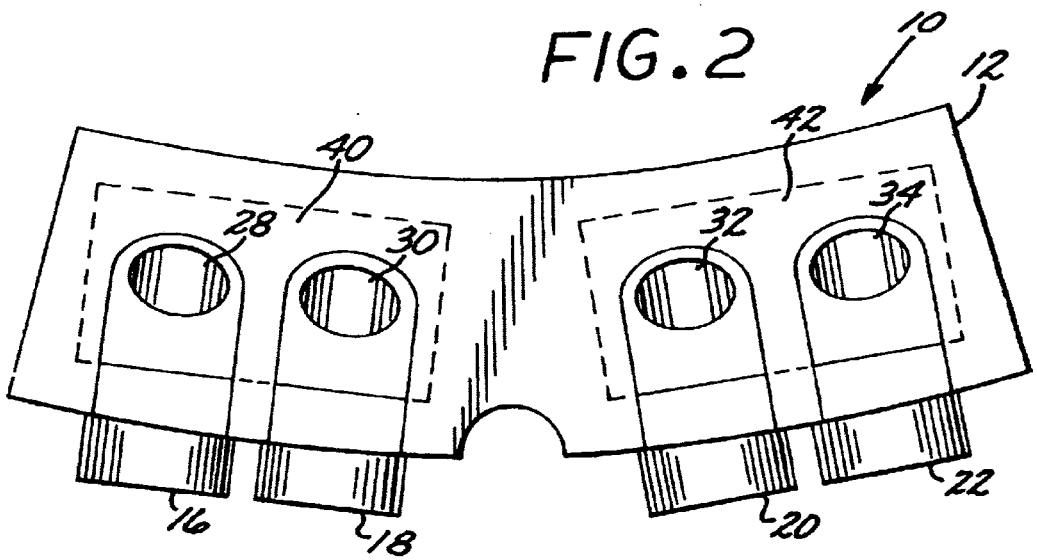
FIG. 2 is a bottom view of the block assembly shown in FIG. 1.
Figure 3:
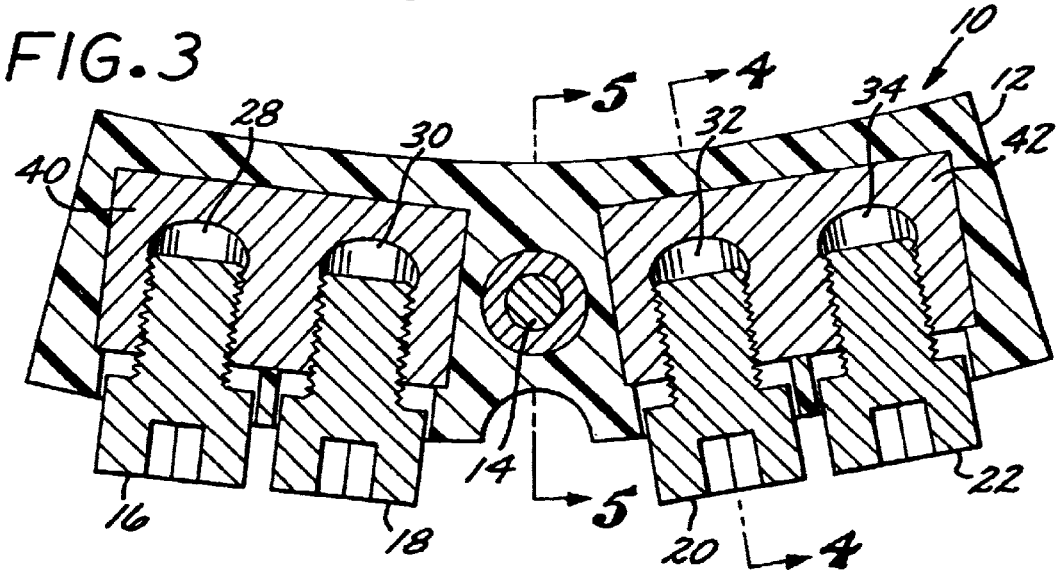
FIG. 3 is a cross-sectional view along line 3—3 of FIG. 1.

FIG. 2 is a bottom view of the block shown in FIG. 1 and illustrates four receiving ports 28, 30, 32 and 34. FIG. 3 is a cross-sectional view along line 3—3 of FIG. 1 and illustrates set screws 16, 18, 20 and 22 inserted into wire ports 28, 30, 32 and 34, respectively through apertures formed in terminal block 12. Ports 28 and 30 are formed in a machined metal block 40 and ports 32 and 34 are formed in machined metal block 42. Metal blocks 40 and 42 electrically couple ports 28 and 30 and 32 and 34, respectively. Set screws 16, 18, 20 and 22 connect the input lead wires from multiple speakers to the terminal block assembly 10. Metal blocks 40 and 42 do not deform from the heat generated when the lead wires are soldered to assembly 10, an improvement to existing terminal blocks.

Assembly 10 enables two positive input channels 28 and 30 to be coupled together and two negative input channels 32 and 34 to be coupled together, improving terminal reliability for applications requiring specific wire connections. In addition, a connecting wire is not required, reducing manufacturing costs.

FIG. 6 is a front elevational view of a two channel assembly 50 formed in accordance with the teachings of the present invention and FIG. 7 is a top view thereof Assembly 50 comprises plastic block 52, screw 54, wire retaining screws 56 and 58 and input terminals 60 and 62 connected to the output of the speaker power amplifier (not shown). Assembly 50 has receiving ports 64 and 66 (FIG. 8), retaining screws 56 and 58 being positioned in ports 64 and 66, respectively, as illustrated. Ports 64 and 66 are formed in metal holder 68. As with the embodiment shown in FIGS. 1–5, metal holder 68 does not deform as a result of the heat generated when the lead in wires are soldered to assembly 50.

The design of the terminal blocks as set forth hereinabove allows the wiring connection of multiple speakers, or woofers, in parallel or series, providing dual voice coil coupling and impedance ohms variations in a simple and cost efficient manner.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. An electrical terminal block comprising:

an elongated plastic member;

a first metal block formed within said plastic member;

a second metal holder formed in said plastic member and spaced from said first metal holder;

first and second wire ports formed in said first metal block;

third and fourth wire ports formed in said second metal block;

first and second fasteners for securing terminal wires in said first and second wire ports and;

third and fourth fasteners for securing terminal wires in said third and fourth wire ports, said first metal block electrically coupling said terminal wires in said first and second wire ports, said second metal block electrically coupling said terminal wires in said third and fourth wire ports wherein said first, second, third and fourth fasteners are positioned along on one side of said elongated plastic member and a mounting screw on the elongated plastic member is positioned between said first and second metal blocks.

* * * * *